US007278641B1

(12) United States Patent
Soo

(10) Patent No.: US 7,278,641 B1
(45) Date of Patent: Oct. 9, 2007

(54) ADJUSTABLE SKATE

(76) Inventor: Mike Soo, No. 2, Lane 1102, Dawan Rd., Yongkang, Tainan Hsien (TW)

( * ) Notice: Subject to any disclaimer, the term of this patent is extended or adjusted under 35 U.S.C. 154(b) by 0 days.

(21) Appl. No.: 11/537,821

(22) Filed: Oct. 2, 2006

(51) Int. Cl.
*A63C 1/26* (2006.01)

(52) U.S. Cl. ..... 280/11.26; 280/11.16; 280/11.19

(58) Field of Classification Search ..... 280/11.16, 280/11.26, 11.19, 11.221, 11.27, 11.12, 11.231; 36/97, 115
See application file for complete search history.

(56) References Cited

U.S. PATENT DOCUMENTS

| | | | | | |
|---|---|---|---|---|---|
| 464,312 | A | * | 12/1891 | Bryant | 280/11.16 |
| 686,812 | A | * | 11/1901 | Kiss, Jr. | 280/11.16 |
| 1,265,994 | A | * | 5/1918 | Brown | 280/11.16 |
| 1,342,773 | A | * | 6/1920 | Slawinski | 280/11.26 |
| 1,458,243 | A | * | 6/1923 | Reach | 280/11.26 |
| 1,633,413 | A | * | 6/1927 | La Marca | 36/91 |
| 4,083,128 | A | * | 4/1978 | Rossman | 36/97 |
| 5,224,718 | A | | 7/1993 | Gertler | 208/11.19 |
| 5,295,701 | A | | 3/1994 | Reiber et al. | 280/11.231 |
| 5,416,988 | A | | 5/1995 | Potter et al. | 36/89 |
| 5,484,149 | A | | 1/1996 | Lee | 280/11.26 |
| 5,645,288 | A | | 7/1997 | Lu | 280/11.26 |
| 5,794,362 | A | | 8/1998 | Polk et al. | 36/97 |
| 5,819,438 | A | | 10/1998 | Wanniarachchi | 36/3 R |
| 5,836,592 | A | | 11/1998 | Chang | 280/11.26 |
| 5,931,478 | A | | 8/1999 | Chang | 280/11.231 |
| 6,050,574 | A | | 4/2000 | Olson et al. | 280/11.231 |
| 6,082,027 | A | | 7/2000 | Wagonhurst | 36/97 |
| 6,217,039 | B1 | | 4/2001 | Iverson et al. | |
| 6,438,872 | B1 | * | 8/2002 | Chil et al. | 36/97 |
| 6,450,510 | B1 | * | 9/2002 | Liu | 280/11.26 |
| 6,547,261 | B2 | * | 4/2003 | Gorza et al. | 280/11.223 |
| 6,588,771 | B2 | | 7/2003 | Olson et al. | 280/11.221 |
| 6,655,050 | B1 | | 12/2003 | Lowe | 36/93 |
| 6,669,210 | B2 | * | 12/2003 | Chen | 280/11.16 |
| 6,746,027 | B1 | * | 6/2004 | Soo | 280/11.26 |
| 6,827,355 | B2 | * | 12/2004 | Soo | 280/11.19 |
| 6,932,360 | B2 | * | 8/2005 | Wegener et al. | 280/11.16 |
| 6,983,942 | B2 | * | 1/2006 | Chen | 280/11.26 |
| 2001/0054242 | A1 | | 12/2001 | Miller, II | 36/127 |
| 2002/0035794 | A1 | | 3/2002 | Koyle | 36/29 |
| 2004/0108665 | A1 | * | 6/2004 | Soo | 280/11.26 |
| 2004/0160022 | A1 | * | 8/2004 | Chen | 280/11.26 |
| 2005/0057008 | A1 | * | 3/2005 | Yiu Lu | 280/11.26 |
| 2007/0040342 | A1 | * | 2/2007 | Lin | 280/11.26 |

* cited by examiner

*Primary Examiner*—J. Allen Shriver
(74) *Attorney, Agent, or Firm*—Alan Kamrath; Kamrath & Associates PA

(57) ABSTRACT

An adjustable skate includes a boot, a liner, and an adjusting device. The boot includes a toe cap, a heel portion, and a sole. The liner is mounted in the boot and includes a bottom plate and a toe box. A chamber is defined between the toe box and the heel portion of the boot for receiving a foot of a wearer. The adjusting device is mounted below the sole and includes a screw rod and a screw rod jacket. The screw rod jacket includes a longitudinal screw hole threadedly engaged with a threaded portion of the screw rod. The screw rod jacket is fixed below the liner to move therewith. When the screw rod is turned, the screw rod jacket moves in a longitudinal direction of the screw rod and the liner moves in a lengthwise direction of the chamber.

8 Claims, 4 Drawing Sheets

ADJUSTABLE SKATE

BACKGROUND OF THE INVENTION

1. Field of the Invention

The present invention relates to an adjustable skate and, more particularly, to an adjustable skate that is adjustable in a length of a chamber in the boot of the adjustable skate according to different foot lengths of different wearers.

2. Description of the Related Art

Skating is popular among young people, for it is an exciting yet healthy sport allowing users to enjoy speed (e.g., speed skating) and beauty (e.g., figure skating or ice dancing) and thus. A typical skate, whether of wheel type or blade type, includes a boot and a sole. The boot is generally made of plastic material to protect the wearer's foot from external impact. Mounted below the sole is a base to which a blade or wheels are attached.

Skates are expensive, and most users are young people that are still growing. Hence, many skates are adjustable in length and/or width to suit different foot sizes of various wearers. Nevertheless, the adjusting mechanisms of the skates are complicated and, thus, costly. Further, the adjusting procedures for the adjusting mechanisms are troublesome and time-consuming, as they include detachment of bolts and screws before adjustment as well as reassembling of the bolts and screws after adjustment.

Applicant's U.S. Pat. No. 6,746,027 discloses an adjustable skate including a boot, a liner, and a bladder. A chamber for receiving a foot of a wearer is defined between a toe box of the liner and a heel portion of the boot. The bladder has a volume that is adjustable through filling/discharging air into/out of the bladder to move the liner in a lengthwise direction of the boot, thereby changing the length of the chamber. However, it is inconvenient for a skater to carry an inflating device. Further, the inflated bladder cannot maintain a fixed shape after a period of time. Further, it is difficult to precisely control the amount of air to be discharged from the bladder for the purposes of enlarging the chamber.

Applicant's U.S. Pat. No. 6,827,355 discloses an adjustable skate including a boot, a liner, and an adjusting member. A chamber for receiving a foot of a wearer is defined between a toe box of the liner and a heel portion of the boot. The adjusting member includes a screw hole threadedly engaged with a bolt on the liner. When the adjusting member is turned, the liner moves in a lengthwise direction of the boot, thereby changing the length of the chamber. However, the adjusting member is mounted in the toe cap of the boot that is liable to be impacted during skating. Namely, the adjusting member is liable to be damaged by external impact and, thus, fails to provide the adjusting function.

SUMMARY OF THE INVENTION

An adjustable skate in accordance with the present invention comprises a boot, a liner, and an adjusting device. The boot includes a toe cap, a heel portion, and a sole. A compartment is defined between the toe cap and the heel portion. The sole includes a slot. The liner is mounted in the compartment and includes a bottom plate and a toe box. A chamber is defined between the toe box and the heel portion of the boot for receiving a foot of a wearer.

The adjusting device is mounted below the sole and includes a screw rod, a screw rod jacket, and front and rear screw rod seats. The screw rod includes a front end, a rear end, and a threaded portion between the front end and the rear end. The screw rod jacket includes a longitudinal screw hole threadedly engaged with the threaded portion of the screw rod. The screw rod jacket extends through the slot of the sole and is fixed below the liner to move jointly with the liner. The front and rear screw rod seats are mounted below the sole for respectively supporting the front and rear ends of the screw rod.

When the screw rod is turned, the screw rod jacket moves in a longitudinal direction of the screw rod and the liner moves in a lengthwise direction of the chamber. Thus, the size of the chamber can be adjusted to suit various foot sizes.

Preferably, a base is mounted below the sole and includes a receiving space for receiving the adjusting device. This protects the adjusting device from external impact.

Preferably, the sole includes a front portion contiguous to the toe cap and a rear portion contiguous to the heel portion, and the slot is defined in the front portion of the sole.

Preferably, a midsole is mounted on top of the sole. The midsole includes a front portion contiguous to the toe cap and a rear portion contiguous to the heel portion. The midsole further includes a slot aligned with the slot of the sole. The midsole improves wearing comfort.

Preferably, the front and rear screw rod seats are located below the sole and respectively at front and rear sides of the slots. The front screw rod seat includes a hole for receiving the front end of the screw rod. The rear screw rod seat includes a hole for receiving the rear end of the screw rod.

In an example, the rear screw seat includes a bearing mounted in the hole of the rear screw seat. The bearing receives the rear end of the screw rod. A clip is provided to fix the screw rod and the bearing to thereby position the screw rod in the longitudinal direction.

Preferably, the front and rear ends of the screw rod have no threads, and the front end of the screw rod includes a groove in an end face thereof for engaging with a tool.

Preferably, the groove is hexagonal for engaging with a hexagonal wrench.

Other objectives, advantages, and features of the invention will become more apparent from the following detailed description when taken in conjunction with the accompanying drawings.

DETAILED DESCRIPTION OF THE PREFERRED EMBODIMENT

Figure 1:
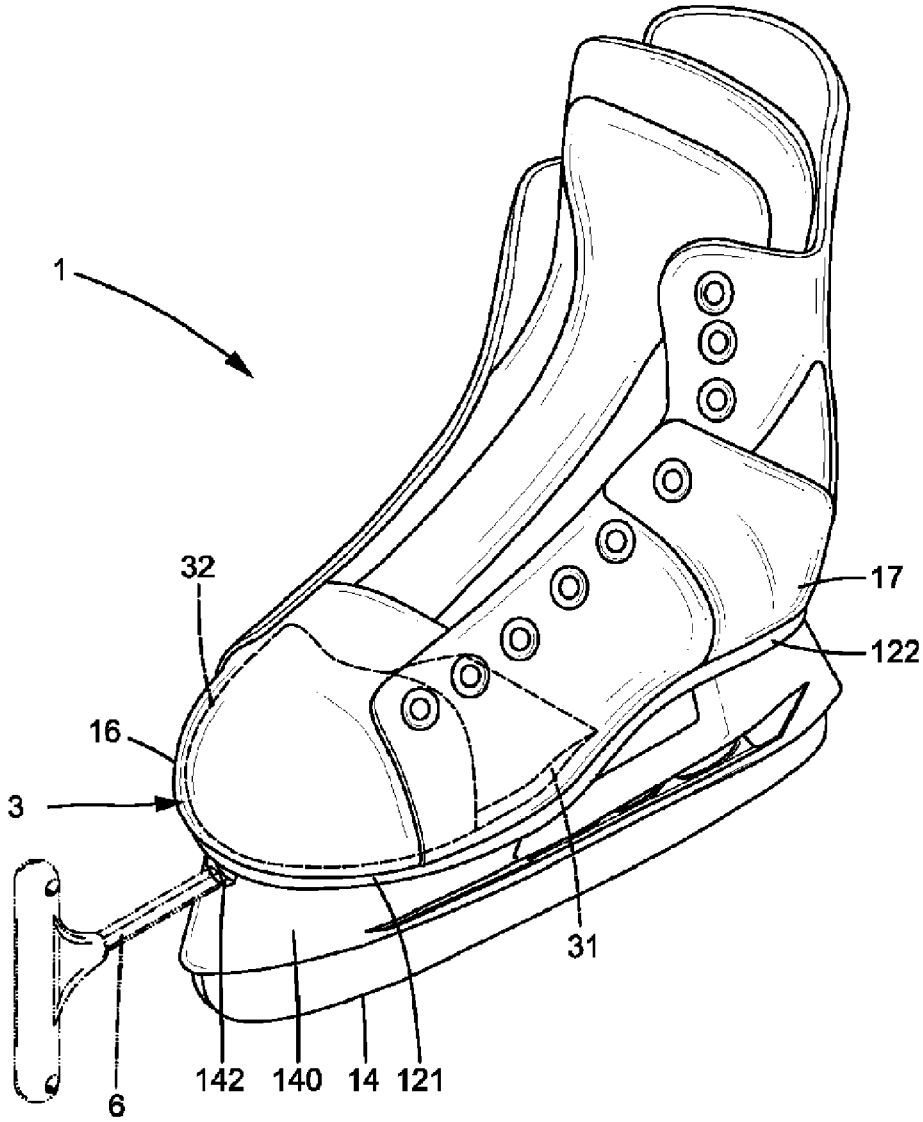
FIG. 1 is a perspective view of an adjustable skate in accordance with the present invention.
Figure 2:
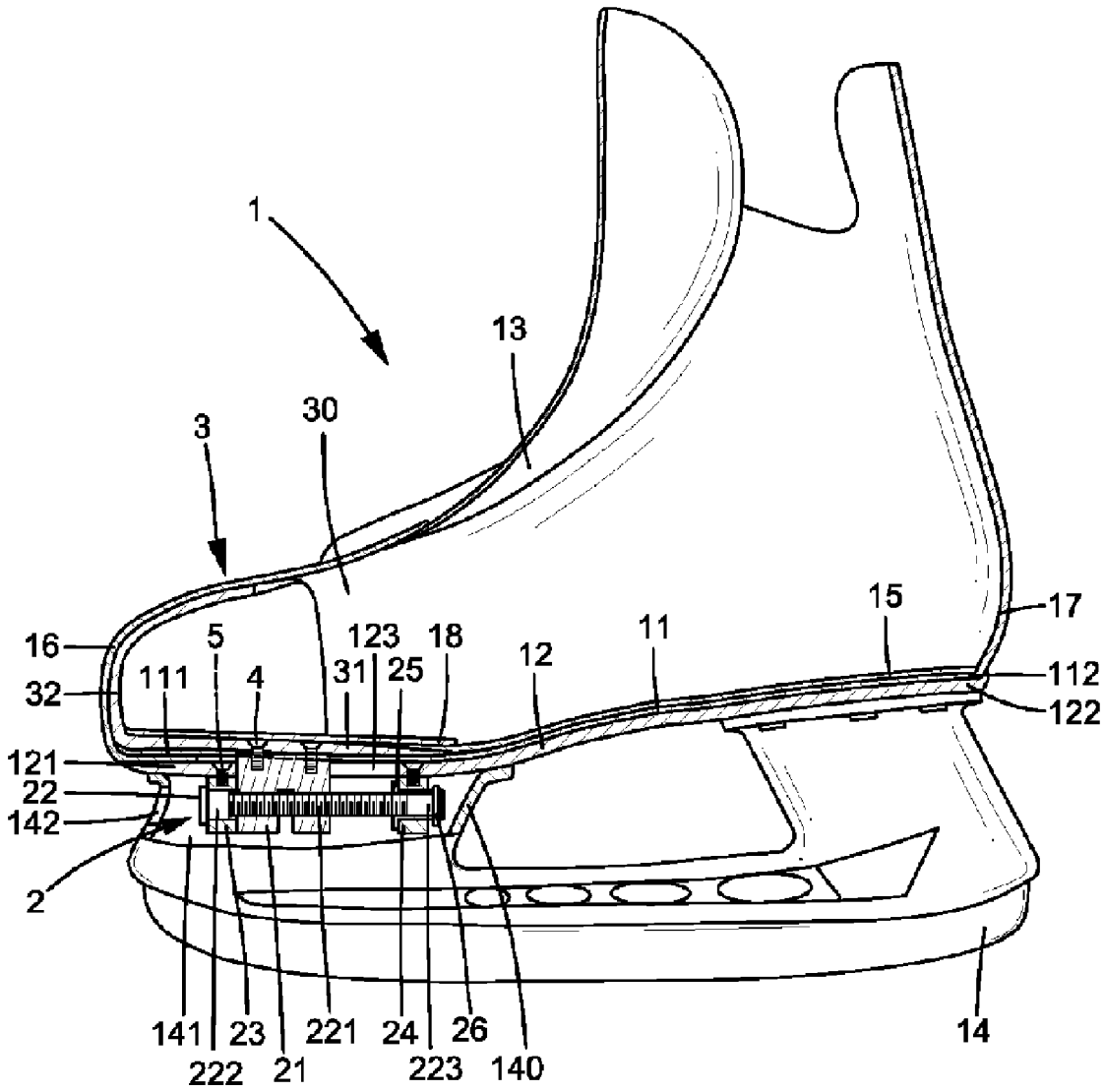
FIG. 2 is a side view, partially sectioned, of the adjustable skate in accordance with the present invention.
Figure 3:
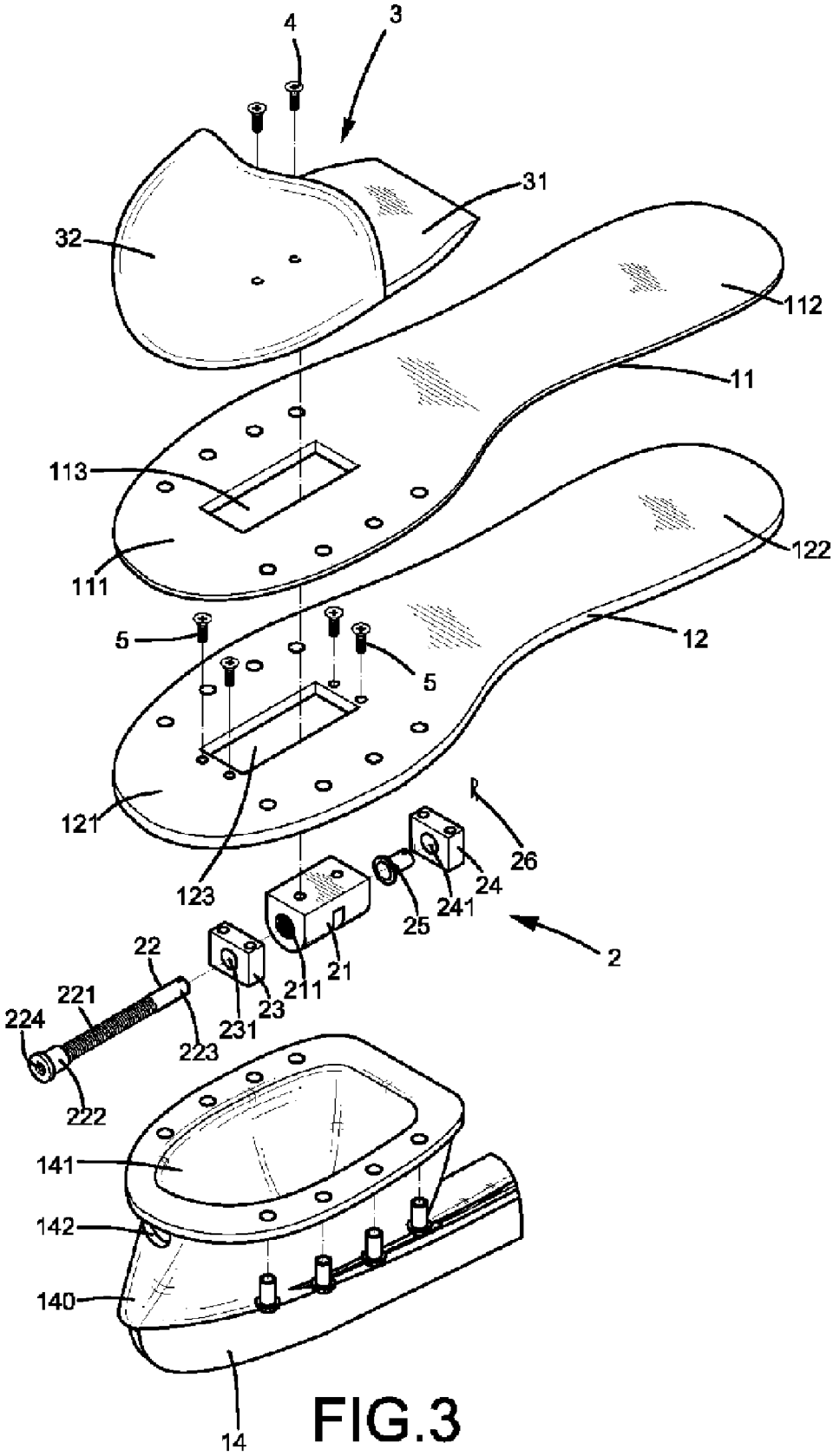
FIG. 3 is an exploded perspective view of a portion of the adjustable skate in accordance with the present invention.

Referring to FIGS. 1 through 3, an adjustable skate in accordance with the present invention comprises a boot 1, an adjusting device 2, and a liner 3 mounted in the boot 1. The boot 1 includes a top cap 16, a heel portion 17, and a sole 12. The sole 12 includes a front portion 121 contiguous to the toe cap 16 and a rear portion 122 contiguous to the heel portion 17. A compartment 13 is defined between the toe cap 16 and the heel portion 17. Mounted below the sole 12 is a base 140 to which a blade 14 is mounted. Of course, the blade 14 can be replaced with wheels or rollers.

The liner 3 is mounted in the compartment 13 and includes a bottom plate 31 and a toe box 32 on a front end of the bottom plate 31. The toe box 32 is configured approximately the same as the top cap 16, and the bottom plate 31 is smaller than the sole 12, allowing the liner 3 to slide in the compartment 13 in a lengthwise direction of the boot 1. A chamber 30 is defined between the toe box 32 and the heel portion 17 for receiving a foot of a wearer. The size of the chamber 30 depends on the position of the liner 3 in the compartment 13.

In this example, a midsole 11 is mounted above the sole 12 and has a front portion 111 contiguous to the toe cap 16 and a rear portion 112 contiguous to the heel portion 17 of the boot 1. The liner 3 is placed on the front portion 111 of the midsole 11. A pad 15 may be placed on the midsole 11 and another pad 18 may be placed on the bottom plate 31 of the liner 3.

Referring to FIGS. 2 and 3, the adjusting device 2 includes a screw rod 22 below the liner 3, a screw rod jacket 21 mounted on the screw rod 22, and front and rear screw rod seats 23 and 24 through which the screw rod 22 extends. The adjusting device 2 is mounted in a lengthwise direction of the boot 1 and received in a space below the sole 12 at a front portion of the boot 1. In this example, the base 140 includes a receiving space 141 for accommodating the adjusting device 2, as shown in FIG. 2.

Figure 4:
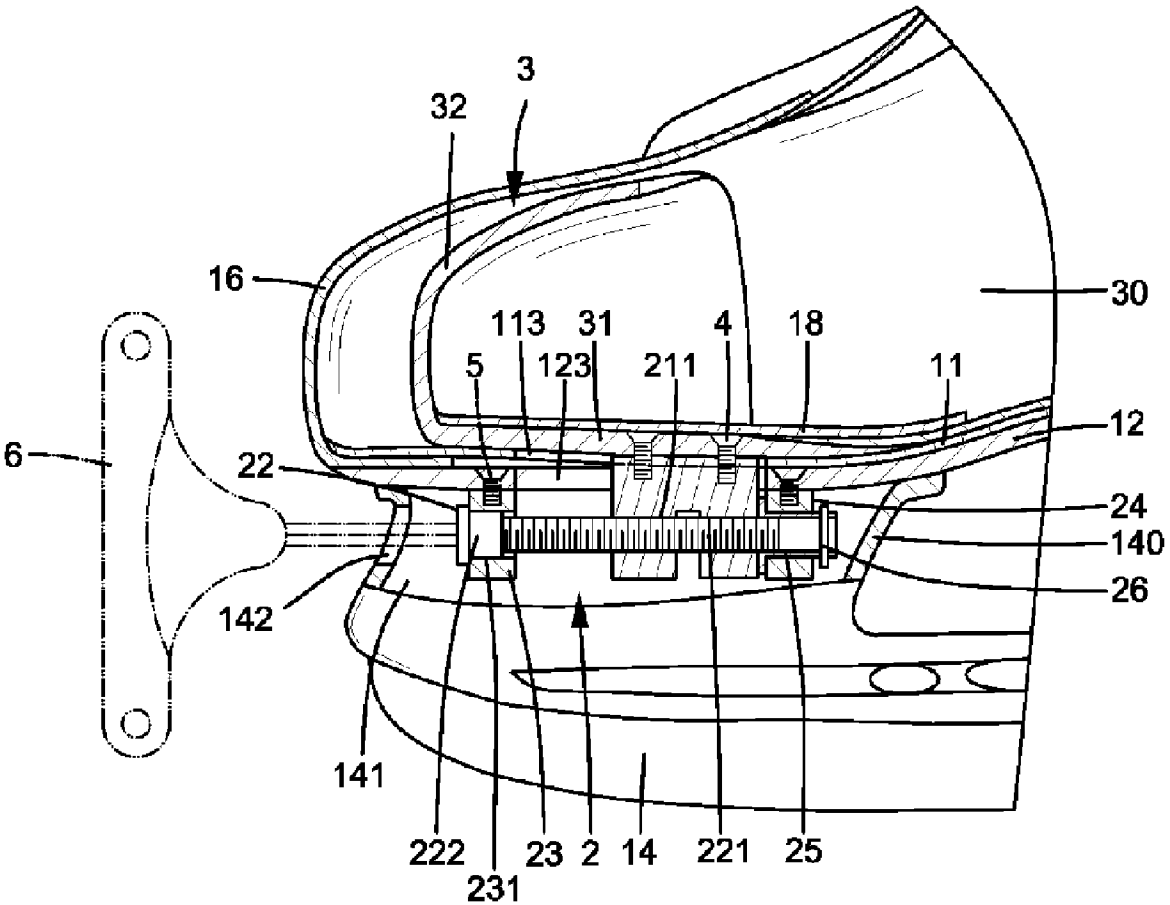
FIG. 4 is an enlarged view of a front portion of the adjustable skate in FIG. 2, illustrating adjustment by a tool.

Referring to FIGS. 3 and 4, a slot 123 is defined in the front portion 121 of the sole 12 whereas another slot 113 is defined in the front portion 111 of the midsole 11 and aligned with the slot 123 in the sole 12. Each slot 113, 123 is longer than the screw rod jacket 21, allowing the screw rod jacket 21 to move in the slots 113 and 123 in the lengthwise direction. The screw rod jacket 21 is fixed by screws 4 to the bottom plate 31 of the liner 3, allowing joint movement of the screw rod jacket 21 and the liner 3. It is noted that the screw rod jacket 21 extends through the slots 113 and 123 in the vertical direction into the receiving space 141.

The screw rod jacket 21 includes a longitudinal screw hole 211. The screw rod 22 includes a front end 222, a rear end 223 and a threaded portion 221 between the front end 222 and the rear end 223. The threaded portion 221 of the screw rod 22 is threadedly engaged with the screw hole 211 of the screw rod jacket 21. The front and rear ends 222 and 223 have no threads. A groove 224 (a hexagonal groove in this example) is defined in an end face of the front end 222 of the screw rod 22. A tool 6 (such as a hexagonal wrench) may be engaged with the groove 224 for driving the screw rod 22 for adjusting the size of the chamber 30.

As illustrated in FIG. 2, the screw rod seats 23 and 24 are fixed below the sole 12 by screws 5 and respectively located at front and rear sides of the slots 123. Each screw rod seat 23, 24 include a hole 231, 241 for receiving an associated end 222, 223 of the screw rod 22. In this example, a bearing 25 is mounted in the hole 241 of the screw rod seat 24, and a clip 26 is provided to fix the screw rod 22 and the bearing 25. This fixes the screw rod 22 in the longitudinal direction. Namely, when the screw rod 22 rotates clockwise or counterclockwise, the screw rod jacket 21 moves longitudinally (i.e., toward or away from the front end 222 of the screw rod 22) on the screw rod 22 that rotates idly.

Referring to FIGS. 1 through 3, the base 140 further includes an opening 142 that communicates the receiving space 141 with outside. A tool 6 (such as a hexagonal wrench) may be extended through the opening 142 to engage with the groove 224 of the front end 222 of the screw rod 22 for the purposes of driving the screw rod 22.

Referring to FIGS. 2 and 4, when adjustment in the size of the chamber 30 is required, the tool 6 is turned to move the screw rod jacket 21 in the longitudinal direction of the screw rod 22. The liner 3 is moved in the lengthwise direction of the boot 1 to change the length of the chamber 30 (the distance between the toe box 32 and the heel portion 17).

The liner 3 in FIG. 2 is in a position nearest to the toe cap 16, and the chamber 30 is the largest. The liner 3 in FIG. 4 is in a position farthest to the toe cap 16, and the chamber 30 is the smallest. The liner 3 is adjustable between the two positions in response to the size of the foot of the wearer. Operation of the adjusting device 2 is simple and easy; namely, adjustment can be achieved without effort. Further, the adjusting device 2 is mounted below the sole 12 in a position behind the toe cap 16 without adversely affecting wearing comfort and without the risk of being damaged by external impact.

Although a specific embodiment has been illustrated and described, numerous modifications and variations are still possible. The scope of the invention is limited by the accompanying claims.

What is claimed is:

1. An adjustable skate comprising:

a boot including a toe cap, a heel portion, and a sole, a compartment being defined between the toe cap and the heel portion, the sole including a slot;

a liner mounted in the compartment and including a bottom plate and a toe box, a chamber being defined between the toe box and the heel portion of the boot for receiving a foot of a wearer; and an adjusting device mounted below the sole and including a screw rod, a screw rod jacket, and front and rear screw rod seats, the screw rod including a front end, a rear end, and a threaded portion between the front end and the rear end, the screw rod jacket including a longitudinal screw hole threadedly engaged with the threaded portion of the screw rod, the screw rod jacket extending through the slot of the sole and being fixed below the liner to move jointly with the liner, the front and rear screw rod seats being mounted below the sole for respectively supporting the front and rear ends of the screw rod;

wherein when the screw rod is turned, the screw rod jacket moves in a longitudinal direction of the screw rod and the liner moves in a lengthwise direction of the chamber.

2. The adjustable skate as claimed in claim 1 further comprising a base mounted below the sole, the base including a receiving space for receiving the adjusting device.

3. The adjustable skate as claimed in claim 1 wherein the sole includes a front portion contiguous to the toe cap and a rear portion contiguous to the heel portion, and wherein the slot is defined in the front portion of the sole.

4. The adjustable skate as claimed in claim 3 further including a midsole on top of the sole, the midsole including a front portion contiguous to the toe cap and a rear portion contiguous to the heel portion, the midsole further including a slot aligned with the slot of the sole.

5. The adjustable skate as claimed in claim 1 wherein the front and rear screw rod seats are located below the sole and respectively at front and rear sides of the slots, the front screw rod seat including a hole for receiving the front end of the screw rod, the rear screw rod seat including a hole for receiving the rear end of the screw rod.

6. The adjustable skate as claimed in claim 5 wherein the rear screw seat includes a bearing mounted in the hole of the rear screw seat, the bearing receiving the rear end of the screw rod, further including a clip for fixing the screw rod and the bearing to position the screw rod in the longitudinal direction.

7. The adjustable skate as claimed in claim 1 wherein the front and rear ends of the screw rod have no threads and wherein the front end of the screw rod includes a groove in an end face thereof.

8. The adjustable skate as claimed in claim 7 wherein the groove is hexagonal.

* * * * *